US011234524B1

(12) United States Patent
Tsai

(10) Patent No.: US 11,234,524 B1
(45) Date of Patent: Feb. 1, 2022

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/087,574

(22) Filed: Nov. 2, 2020

(51) Int. Cl.
*A47C 4/28* (2006.01)
*A47C 11/00* (2006.01)

(52) U.S. Cl.
CPC ..... *A47C 4/283* (2013.01); *A47C 4/286* (2013.01); *A47C 11/00* (2013.01); *A47C 11/005* (2013.01)

(58) Field of Classification Search
CPC ..... A47C 4/283; A47C 4/286; A47C 11/00; A47C 11/05
USPC ..... 297/16.2, 35, 36, 42, 45, 232, 248, 297/440.11
See application file for complete search history.

(56) References Cited

U.S. PATENT DOCUMENTS 1,858,254 A * 5/1932 Uline ..... A47C 4/38 297/36
5,570,928 A * 11/1996 Staunton ..... A47C 11/005 297/232
10,130,181 B1 * 11/2018 Chen ..... A47C 4/283
2010/0013273 A1 * 1/2010 Chen ..... A47C 4/283 297/42
2010/0171342 A1 * 7/2010 Chen ..... A47C 4/283 297/45
2010/0187866 A1 * 7/2010 Chen ..... A47C 4/283 297/16.1
2011/0169304 A1 * 7/2011 Chen ..... A47C 4/283 297/35
2020/0154891 A1 * 5/2020 Frankel ..... A47C 4/283

FOREIGN PATENT DOCUMENTS

BE 847608 A * 2/1977 ..... A47C 1/12
JP 2003174948 A * 6/2003 ..... A47C 4/283
JP 2010213788 A * 9/2010 ..... A47C 4/00

* cited by examiner

*Primary Examiner* — Robert Canfield

(57) ABSTRACT

A folding chair includes U-shaped first to fourth supporting frame members, U-shaped first to third legs, inverted U-shaped first and second armrests, first to fourth seat receivers, first to fourth front supports, first to fourth rear supports, first to fourth front connecting members, first to fourth rear connecting members, first to third backrest supports, a seat and a backrest. All these members can be smoothly pivotally turned about corresponding couplers or unions, enabling the folding chair to be collapsed into a slim-folded state to occupy a very small space and be easily portable, or be fully extended from the collapsed state to provide improved stability and load capacity in use.

12 Claims, 6 Drawing Sheets

FOLDING CHAIR

BACKGROUND OF THE INVENTION

1. Field of the Invention

The present disclosure relates to a folding chair, and more particularly, to a folding chair that is collapsible into a slim-folded state for storage and extendable for use.

2. Description of the Related Art

A conventional folding chair usually includes a frame, two legs, a seat and a backrest. The legs are pivotally connected to the frame in a crisscross pattern; the seat is pivotally assembled to the frame; and the backrest is assembled to a top of the frame. In this manner, the legs and the seat can be pivotally extended to one side of the frame for a user to sit on the seat, or the legs and the seat can be pivotally moved toward the frame into a collapsed state.

With regard to the above-described conventional folding chair, when it is collapsed with the legs and the seat pivotally moved toward the frame, the frame and the seat still maintain an overall width the same as that of the folding chair in the extended state. Therefore, the conventional folding chair in the collapsed state would still occupy a relatively large space and is not conveniently portable. Further, the conventional folding chair in the extended state is supported on the floor or ground only by a bottom of the frame and the two legs, which provide only limited stability and load capacity.

Thus, it is tried by the inventor to develop an improved folding chair that can be collapsed into a slim-folded state to occupy a very small space and be easily portable, and on the other hand, can be extended into a standing state with high stability and providing good load capacity in use.

BRIEF SUMMARY OF THE INVENTION

An objective of the present disclosure is to eliminate the drawbacks of the conventional folding chair by providing an improved folding chair that can be collapsed into a slim-folded state to occupy a very small space and be easily portable, and on the other hand, can be extended into a standing state with high stability and providing good load capacity in use.

To achieve at least the above objective, the folding chair according to the present disclosure includes a U-shaped first supporting frame member, a U-shaped second supporting frame member, a U-shaped third supporting frame member, a U-shaped fourth supporting frame member, a U-shaped first leg, a U-shaped second leg, a U-shaped third leg, an inverted U-shaped first armrest, an inverted U-shaped second armrest, a first seat receiver, a second seat receiver, a third seat receiver, a fourth seat receiver, a first front support, a second front support, a third front support, a fourth front support, a first rear support, a second rear support, a third rear support, a fourth rear support, a first front connecting member, a second front connecting member, a third front connecting member, a fourth front connecting member, a first rear connecting member, a second rear connecting member, a third rear connecting member, a fourth rear connecting member, a first backrest support, a second backrest support, a third backrest support, a first front pivoting limiter, a second front pivoting limiter, a first rear pivoting limiter, a second rear pivoting limiter, a first front pivotal connector, a second front pivotal connector, a first rear pivotal connector, a second rear pivotal connector, a first front support pivot, a second front support pivot, a third front support pivot, a first rear support pivot, a second rear support pivot, a third rear support pivot, a first front pivot, a second front pivot, a third front pivot, a first rear pivot, a second rear pivot, a third rear pivot, a first backrest support pivot, a second backrest support pivot, a seat, and a backrest. Wherein, the first supporting frame member has two ends separately connected to the first front pivoting limiter and the first rear pivoting limiter; the second supporting frame member is located opposite to the first supporting frame member and has two ends also separately connected to the first front pivoting limiter and the first rear pivoting limiter; the third supporting frame member has two ends separately connected to the second front pivoting limiter and the second rear pivoting limiter; and the fourth supporting frame member is located opposite to the third supporting frame member and has two ends also separately connected to the second front pivoting limiter and the second rear pivoting limiter. The first leg has two upper ends separately connected to the first front pivot and the first rear pivot; the second leg has two upper ends separately connected to the second front pivot and the second rear pivot; and the third leg has two upper ends separately connected to the third front pivot and the third rear pivot. The first armrest has two lower ends separately connected to the first front pivot and the first rear pivot; and the second armrest has two lower ends separately connected to the third front pivot and the third rear pivot. The first seat receiver has two ends separately connected to the first front pivot and the first rear pivot; the second seat receiver has two ends separately connected to the second front pivot and the second rear pivot; the third seat receiver has two ends also separately connected to the second front pivot and the second rear pivot; and the fourth seat receiver has two ends separately connected to the third front pivot and the third rear pivot. The first front support has an upper end connected to the first front pivoting limiter and another lower end connected to the first front support pivot, which is mounted on the first leg near a lower front corner thereof; the second front support has an upper end connected to the first front pivoting limiter and another lower end connected to the second front support pivot, which is mounted on the second leg near a lower front corner thereof; the third front support has an upper end connected to the second front pivoting limiter and another lower end also connected to the second front support pivot; and the fourth front support has an upper end connected to the second front pivoting limiter and another lower end connected to the third front support pivot, which is mounted on the third leg near a lower front corner thereof. The first rear support has an upper end connected to the first rear pivoting limiter, and another lower end connected to the first rear support pivot, which is mounted on the first leg near a lower rear corner thereof; the second rear support has an upper end also connected to the first rear pivoting limiter, and another lower end connected to the second rear support pivot, which is mounted on the second leg near a lower rear corner thereof; the third rear support has an upper end connected to the second rear pivoting limiter, and another lower end also connected to the second rear support pivot; and the fourth rear support has an upper end also connected to the second rear pivoting limiter, and another lower end connected to the third rear support pivot, which is mounted on the third leg near a lower rear corner thereof. The first front connecting member has a lower and an upper end connected to the first front pivotal connector and the first front pivot, respectively; the second front connecting member has a lower and an upper end connected to the first front pivotal connector and the second front pivot, respectively; the third front connecting member has a lower and an upper end connected to the second front pivotal connector and the second front pivot, respectively; and the fourth front connecting member has a lower and an upper end connected to the second front pivotal connector and the third front pivot, respectively. The first rear connecting member has a lower and an upper end connected to the first rear pivotal connector and the first rear pivot, respectively; the second rear connecting member has a lower and an upper end connected to the first rear pivotal connector and the second rear pivot, respectively; the third rear connecting member has a lower and an upper end connected to the second rear pivotal connector and the second rear pivot, respectively; and the fourth rear connecting member has a lower and an upper end connected to the second rear pivotal connector and the third rear pivot, respectively. The first backrest support has a lower end connected to the first backrest support pivot, which is mounted on the first armrest near an upper rear corner thereof; the second backrest support has a lower end connected to the second rear pivot; and the third backrest support has a lower end connected to the second backrest support pivot, which is mounted on the second armrest near an upper rear corner thereof. Wherein, the first front connecting member and the first rear connecting member are assembled to the first supporting frame member; the second front connecting member and the second rear connecting member are assembled to the second supporting frame member; the third front connecting member and the third rear connecting member are assembled to the third supporting frame member; and the fourth front connecting member and the fourth rear connecting member are assembled to the fourth supporting frame member. Wherein, the seat is supported on and connected to the first seat receiver, the second seat receiver, the third seat receiver and the fourth seat receiver; and the backrest is supported on and connected to the first backrest support, the second backrest support and the third backrest support. Wherein, the backrest and the seat are connected to each other.

In an embodiment of the folding chair, the first supporting frame member, the second supporting frame member, the third supporting frame member, the fourth supporting frame member, the first leg, the second leg and the third leg are respectively a U-shaped member; and the first armrest and the second armrest are respectively an inverted U-shaped member.

In an embodiment of the folding chair, the first front pivoting limiter includes a first coupler, a second coupler, a third coupler and a fourth coupler, which are mutually pivotally connected to one another. Wherein, the first coupler is connected to one end of the first supporting frame member, the second coupler is connected to the upper end of the first front support, the third coupler is connected to one end of the second supporting frame member, and the fourth coupler is connected to the upper end of the second front support.

In an embodiment of the folding chair, the second front pivoting limiter includes a fifth coupler, a sixth coupler, a seventh coupler and an eighth coupler, which are mutually pivotally connected to one another. Wherein, the fifth coupler is connected to one end of the third supporting frame member, the sixth coupler is connected to the upper end of the third front support, the seventh coupler is connected to one end of the fourth supporting frame member, and the eighth coupler is connected to the upper end of the fourth front support.

In an embodiment of the folding chair, the first rear pivoting limiter includes a ninth coupler, a tenth coupler, an eleventh coupler and a twelfth coupler, which are mutually pivotally connected to one another. Wherein, the ninth coupler is connected to the other end of the first supporting frame member, the tenth coupler is connected to the upper end of the first rear support, the eleventh coupler is connected to the other end of the second supporting frame member, and the twelfth coupler is connected to the upper end of the second rear support.

In an embodiment of the folding chair, the second rear pivoting limiter includes a thirteenth coupler, a fourteenth coupler, a fifteenth coupler and a sixteenth coupler, which are mutually pivotally connected to one another. Wherein, the thirteenth coupler is connected to the other end of the third supporting frame member, the fourteenth coupler is connected to the upper end of the third rear support, the fifteenth coupler is connected to the other end of the fourth supporting frame member, and the sixteenth coupler is connected to the upper end of the fourth rear support.

In an embodiment of the folding chair, the first front pivot includes a first union, a second union, a third union and a fourth union. Wherein, the first union is connected to an upper front end of the first leg, the second union is pivotally connected to a lower front end of the first armrest, the third union is connected near to a front end of the first seat receiver, and the fourth union is pivotally mounted on the first seat receiver and connected to the upper end of the first front connecting member.

In an embodiment of the folding chair, the second front pivot includes a fifth union, a sixth union, a seventh union, an eighth union and a ninth union. Wherein, the fifth union is connected to an upper front end of the second leg, the sixth union is connected near to a front end of the second seat receiver, the seventh union is connected near to a front end of the third seat receiver, the eighth union is pivotally mounted on the second seat receiver and connected to the upper end of the second front connecting member, and the ninth union is pivotally mounted on the third seat receiver and connected to the upper end of the third front connecting member.

In an embodiment of the folding chair, the third front pivot includes a tenth union, an eleventh union, a twelfth union and a thirteenth union. Wherein, the tenth union is connected to an upper front end of the third leg, the eleventh union is pivotally connected to a lower front end of the second armrest, the twelfth union is connected near to a front end of the fourth seat receiver, and the thirteenth union is pivotally mounted on the fourth seat receiver and connected to the upper end of the fourth front connecting member.

In an embodiment of the folding chair, the first rear pivot includes a fourteenth union, a fifteenth union, a sixteenth union and a seventeenth union. Wherein, the fourteenth union is connected to an upper rear end of the first leg, the fifteenth union is pivotally connected to a lower rear end of the first armrest, the sixteenth union is connected near to a rear end of the first seat receiver, and the seventeenth union is pivotally mounted on the first seat receiver and connected to the upper end of the first rear connecting member.

In an embodiment of the folding chair, the second rear pivot includes an eighteenth union, a nineteenth union, a twentieth union, a twenty-first union and a twenty-second union. Wherein, the eighteenth union is connected to an upper rear end of the second leg, the nineteenth union is connected near to a rear end of the second seat receiver, the twentieth union is connected near to a rear end of the third seat receiver, the twenty-first union is pivotally mounted on the second seat receiver and connected to the upper end of the second rear connecting member, and the twenty-second union is pivotally mounted on the third seat receiver and connected to the upper end of the third rear connecting member; and, the second backrest support is pivotally connected to between the nineteenth union and the twentieth union.

In an embodiment of the folding chair, the third rear pivot includes a twenty-third union, a twenty-fourth union, a twenty-fifth union and a twenty-sixth union. Wherein, the twenty-third union is connected to an upper rear end of the third leg, the twenty-fourth union is pivotally connected to a lower rear end of the second armrest, the twenty-fifth union is connected near to a rear end of the fourth seat receiver, and the twenty-sixth union is pivotally mounted on the fourth seat receiver and connected to the upper end of the fourth rear connecting member.

With the above arrangements, the folding chair of the present disclosure can be collapsed into a slim-folded state to be easily portable without occupying too much space; and the folding chair fully extended from the slim-folded state provides improved stability and load capacity in use.

DETAILED DESCRIPTION OF THE INVENTION

Figure 1:
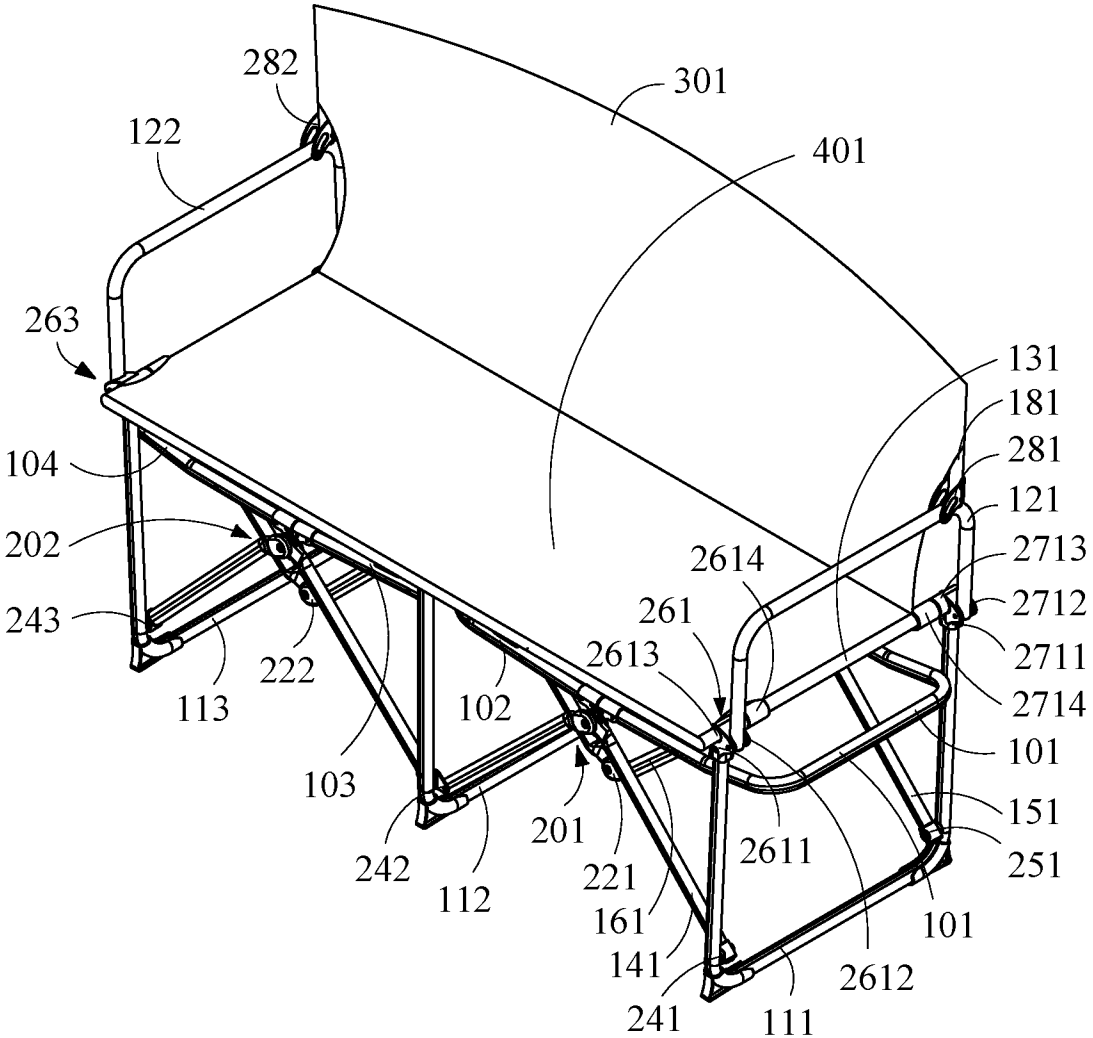
FIG. 1 is a perspective view of a folding chair according to an embodiment of the present disclosure, showing the folding chair in a fully extended state.

To facilitate understanding of the objects, characteristics and effects of this present disclosure, embodiments together with the attached drawings for the detailed description of the present disclosure are provided. It is noted the present disclosure can be implemented or applied in other embodiments, and many changes and modifications in the described embodiments can be carried out without departing from the spirit of the disclosure, and it is also understood that the preferred embodiments are only illustrative and not intended to limit the present disclosure in any way.

Please refer to FIGS. 1 to 6. As shown, the folding chair according to an embodiment of the present disclosure includes a U-shaped first supporting frame member 101, a U-shaped second supporting frame member 102, a U-shaped third supporting frame member 103, a U-shaped fourth supporting frame member 104, a U-shaped first leg 111, a U-shaped second leg 112, a U-shaped third leg 113, an inverted U-shaped first armrest 121, an inverted U-shaped second armrest 122, a first seat receiver 131, a second seat receiver 132, a third seat receiver 133, a fourth seat receiver 134, a first front support 141, a second front support 142, a third front support 143, a fourth front support 144, a first rear support 151, a second rear support 152, a third rear support 153, a fourth rear support 154, a first front connecting member 161, a second front connecting member 162, a third front connecting member 163, a fourth front connecting member 164, a first rear connecting member 171, a second rear connecting member 172, a third rear connecting member 173, a fourth rear connecting member 174, a first backrest support 181, a second backrest support 182, a third backrest support 183, a first front pivoting limiter 201, a second front pivoting limiter 202, a first rear pivoting limiter 211, a second rear pivoting limiter 212, a first front pivotal connector 221, a second front pivotal connector 222, a first rear pivotal connector 231, a second rear pivotal connector 232, a first front support pivot 241, a second front support pivot 242, a third front support pivot 243, a first rear support pivot 251, a second rear support pivot 252, a third rear support pivot 253, a first front pivot 261, a second front pivot 262, a third front pivot 263, a first rear pivot 271, a second rear pivot 272, a third rear pivot 273, a first backrest support pivot 281, a second backrest support pivot 282, a seat 301, and a backrest 401.

The first supporting frame member 101 has two ends separately connected to the first front pivoting limiter 201 and the first rear pivoting limiter 211; the second supporting frame member 102 is located opposite to the first supporting frame member 101 and has two ends also separately connected to the first front pivoting limiter 201 and the first rear pivoting limiter 211; the third supporting frame member 103 has two ends separately connected to the second front pivoting limiter 202 and the second rear pivoting limiter 212; and the fourth supporting frame member 104 is located opposite to the third supporting frame member 103 and has two ends also separately connected to the second front pivoting limiter 202 and the second rear pivoting limiter 212. The first leg 111 has two upper ends separately connected to the first front pivot 261 and the first rear pivot 271; the second leg 112 has two upper ends separately connected to the second front pivot 262 and the second rear pivot 272; and the third leg 113 has two upper ends separately connected to the third front pivot 263 and the third rear pivot 273. The first armrest 121 has two lower ends separately connected to the first front pivot 261 and the first rear pivot 271; and the second armrest 122 has two lower ends separately connected to the third front pivot 263 and the third rear pivot 273. The first seat receiver 131 has two ends separately connected to the first front pivot 261 and the first rear pivot 271; the second seat receiver 132 has two ends separately connected to the second front pivot 262 and the second rear pivot 272; the third seat receiver 133 has two ends also separately connected to the second front pivot 262 and the second rear pivot 272; and the fourth seat receiver 134 has two ends separately connected to the third front pivot 263 and the third rear pivot 273. The first front support 141 has an upper end connected to the first front pivoting limiter 201 and another lower end connected to the first front support pivot 241, which is mounted on the first leg 111 near a lower front corner thereof; the second front support 142 has an upper end connected to the first front pivoting limiter 201 and another lower end connected to the second front support pivot 242, which is mounted on the second leg 112 near a lower front corner thereof; the third front support 143 has an upper end connected to the second front pivoting limiter 202 and another lower end also connected to the second front support pivot 242; and the fourth front support 144 has an upper end connected to the second front pivoting limiter 202 and another lower end connected to the third front support pivot 243, which is mounted on the third leg 113 near a lower front corner thereof. The first rear support 151 has an upper end connected to the first rear pivoting limiter 211, and another lower end connected to the first rear support pivot 251, which is mounted on the first leg 111 near a lower rear corner thereof; the second rear support 152 has an upper end also connected to the first rear pivoting limiter 211, and another lower end connected to the second rear support pivot 252, which is mounted on the second leg 112 near a lower rear corner thereof; the third rear support 153 has an upper end connected to the second rear pivoting limiter 212, and another lower end also connected to the second rear support pivot 252; and the fourth rear support 154 has an upper end also connected to the second rear pivoting limiter 212, and another lower end connected to the third rear support pivot 253, which is mounted on the third leg 113 near a lower rear corner thereof. The first front connecting member 161 has a lower and an upper end connected to the first front pivotal connector 221 and the first front pivot 261, respectively; the second front connecting member 162 has a lower and an upper end connected to the first front pivotal connector 221 and the second front pivot 262, respectively; the third front connecting member 163 has a lower and an upper end connected to the second front pivotal connector 222 and the second front pivot 262, respectively; and the fourth front connecting member 164 has a lower and an upper end connected to the second front pivotal connector 222 and the third front pivot 263, respectively. The first rear connecting member 171 has a lower and an upper end connected to the first rear pivotal connector 231 and the first rear pivot 271, respectively; the second rear connecting member 172 has a lower and an upper end connected to the first rear pivotal connector 231 and the second rear pivot 272, respectively; the third rear connecting member 173 has a lower and an upper end connected to the second rear pivotal connector 232 and the second rear pivot 272, respectively; and the fourth rear connecting member 174 has a lower and an upper end connected to the second rear pivotal connector 232 and the third rear pivot 273, respectively. The first backrest support 181 has a lower end connected to the first backrest support pivot 281, which is mounted on the first armrest 121 near an upper rear corner thereof; the second backrest support 182 has a lower end connected to the second rear pivot 272; and the third backrest support 183 has a lower end connected to the second backrest support pivot 282, which is mounted on the second armrest 122 near an upper rear corner thereof.

The first front connecting member 161 and the first rear connecting member 171 are assembled to the first supporting frame member 101; the second front connecting member 162 and the second rear connecting member 172 are assembled to the second supporting frame member 102; the third front connecting member 163 and the third rear connecting member 173 are assembled to the third supporting frame member 103; and the fourth front connecting member 164 and the fourth rear connecting member 174 are assembled to the fourth supporting frame member 104.

The seat 301 is supported on and connected to the first seat receiver 131, the second seat receiver 132, the third seat receiver 133 and the fourth seat receiver 134; and the backrest 401 is supported on and connected to the first backrest support 181, the second backrest support 182 and the third backrest support 183. Wherein, the backrest 401 and the seat 301 are connected to each other, as shown in FIG. 1. In this way, a user may sit on the seat 301 with his/her back rest on the backrest 401 in a very comfortable manner.

Figure 2:
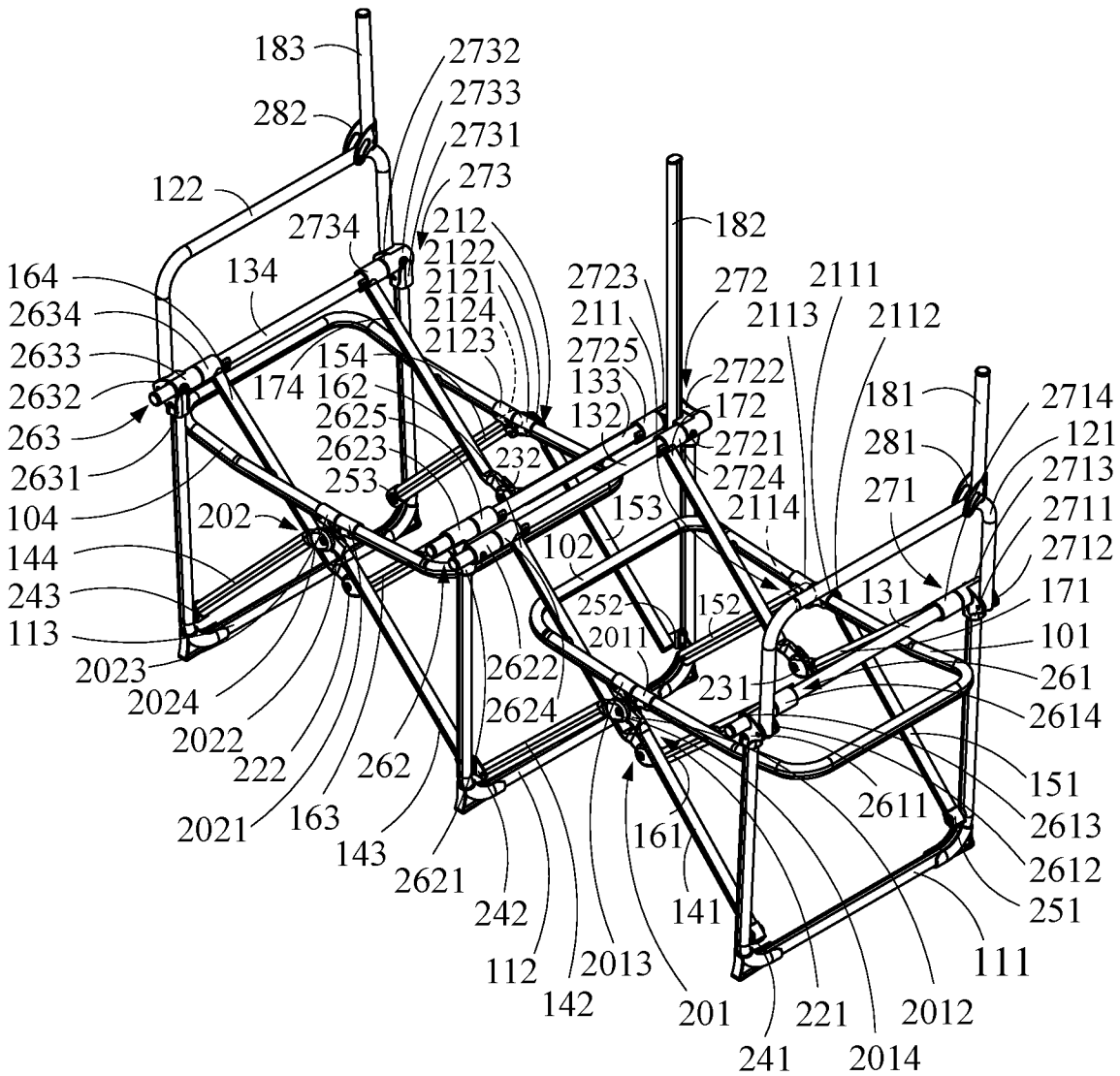
FIG. 2 is a perspective view of the folding chair of FIG. 1 in the extended state with a seat and a backrest omitted therefrom.
Figure 3:
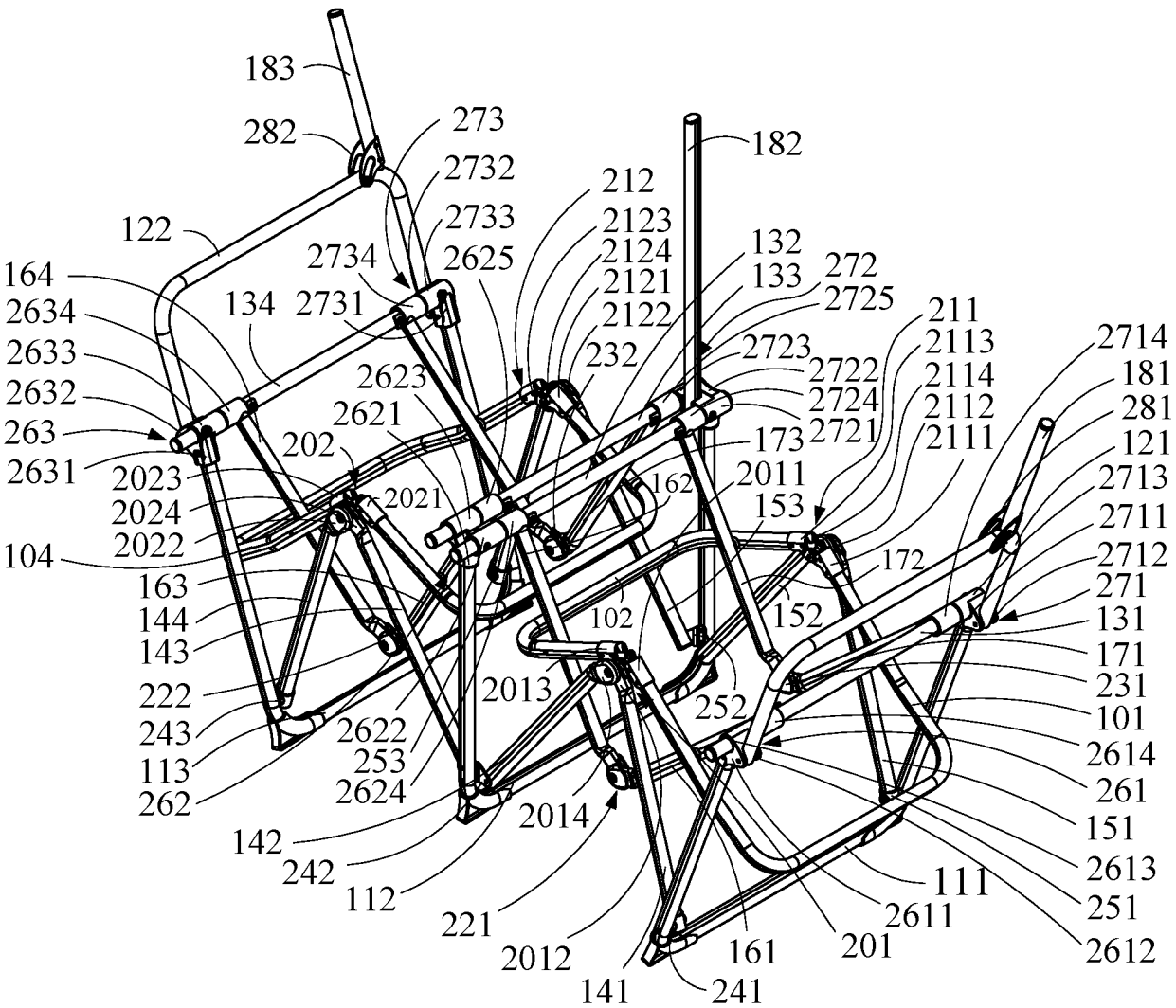
FIG. 3 is a perspective view showing the folding chair of FIG. 2 without the seat and the backrest is partially collapsed.
Figure 4:
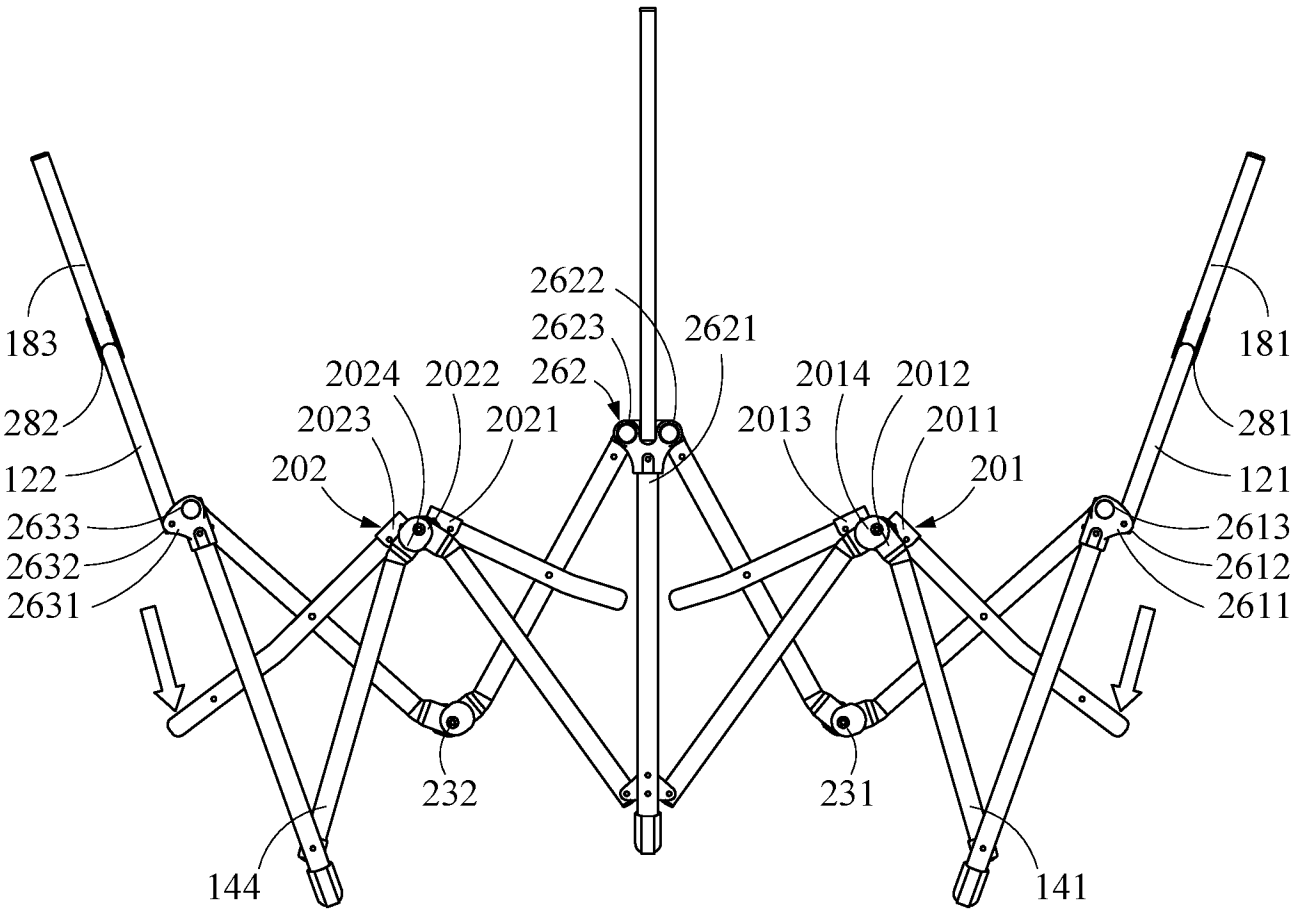
FIG. 4 is a front view of FIG. 3.

As shown in FIGS. 2 to 6, to collapse the folding chair according to the present disclosure, simply apply a downward force on the first supporting frame member 101 and the fourth supporting frame member 104. At this point, as shown in FIGS. 3 and 4, the first supporting frame member 101 is pivotally turned about the first front pivoting limiter 201 and the first rear pivoting limiter 211 to decline toward the first leg 111; meanwhile, the fourth supporting frame member 104 is pivotally turned about the second front pivoting limiter 202 and the second rear pivoting limiter 212 to decline toward the third leg 113.

Please refer to FIGS. 3 and 4. When the first and the fourth supporting frame member 101, 104 are declined toward the first leg 111 and the third leg 113, respectively, the first front support 141 and the second front support 142 are synchronously brought to pivotally turn about the first front pivoting limiter 201, which further brings the first front support pivot 241 and the second front support pivot 242 to pivotally turn. As a result, the first front support 141 and the second front support 142 are brought to move toward each other. Similarly, the first rear support 151 and the second rear support 152 are synchronously brought to pivotally turn about the first rear pivoting limiter 211, which further brings the first rear support pivot 251 and the second rear support pivot 252 to pivotally turn. As a result, the first rear support 151 and the second rear support 152 are brought to move toward each other. Similarly, the first front connecting member 161 and the second front connecting member 162 are synchronously brought to pivotally turn about the first front pivotal connector 221, which further brings the first front pivot 261 and the second front pivot 262 to pivotally turn. As a result, the first front connecting member 161 and the second front connecting member 162 are brought to move toward each other. Similarly, the first rear connecting member 171 and the second rear connecting member 172 are synchronously brought to pivotally turn about the first rear pivotal connector 231, which further brings the first rear pivot 271 and the second rear pivot 272 to pivotally turn. As a result, the first rear connecting member 171 and the second rear connecting member 172 are brought to move toward each other. When the first front connecting member 161, the second front connecting member 162, the first rear connecting member 171 and the second rear connecting member 172 are brought to move, they also bring the second supporting frame member 102 to move toward the first supporting frame member 101 simultaneously.

Also as shown in FIGS. 3 and 4, when the first and the fourth supporting frame member 101, 104 are declined toward the first leg 111 and the third leg 113, respectively, the third front support 143 and the fourth front support 144 are synchronously brought to pivotally turn about the second front pivoting limiter 202, which further brings the second front support pivot 242 and the third front support pivot 243 to pivotally turn. As a result, the third front support 143 and the fourth front support 144 are brought to move toward each other. Similarly, the third rear support 153 and the fourth rear support 154 are synchronously brought to pivotally turn about the second rear pivoting limiter 212, which further brings the second rear support pivot 252 and the third rear support pivot 253 to pivotally turn. As a result, the third rear support 153 and the fourth rear support 154 are brought to move toward each other. Similarly, the third front connecting member 163 and the fourth front connecting member 164 are synchronously brought to pivotally turn about the second front pivotal connector 222, which further brings the second front pivot 262 and the third front pivot 263 to pivotally turn. As a result, the third front connecting member 163 and the fourth front connecting member 164 are brought to move toward each other. Similarly, the third rear connecting member 173 and the fourth rear connecting member 174 are synchronously brought to pivotally turn about the second rear pivotal connector 232, which further brings the second rear pivot 272 and the third rear pivot 273 to pivotally turn. As a result, the second rear connecting member 173 and the fourth rear connecting member 174 are brought to move toward each other. Meanwhile, the first leg 111 and the third leg 113 are brought to move toward the second leg 112. When the third front connecting member 163, the fourth front connecting member 164, the third rear connecting member 173 and the fourth rear connecting member 174 are brought to move, they also bring the third supporting frame member 103 to move toward the fourth supporting frame member 104 simultaneously.

Figure 5:
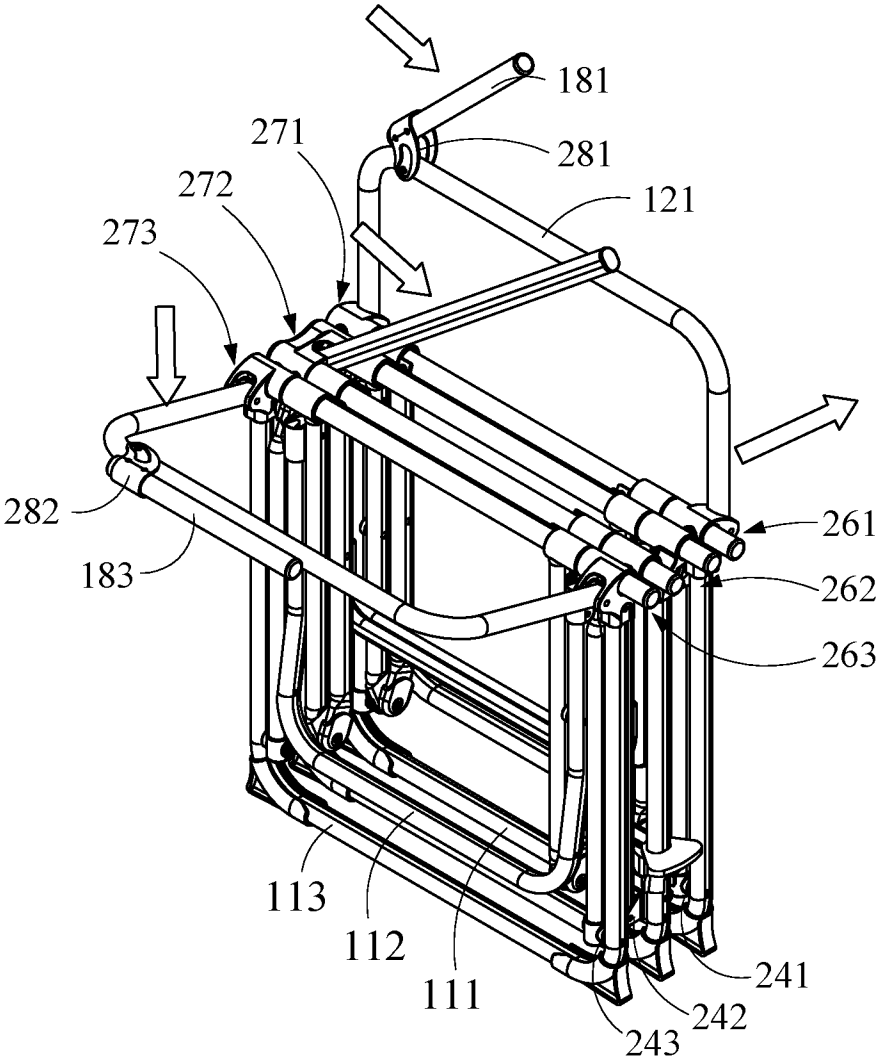
FIG. 5 is a perspective view showing the folding chair of FIG. 2 without the seat and the backrest is almost fully collapsed.
Figure 6:
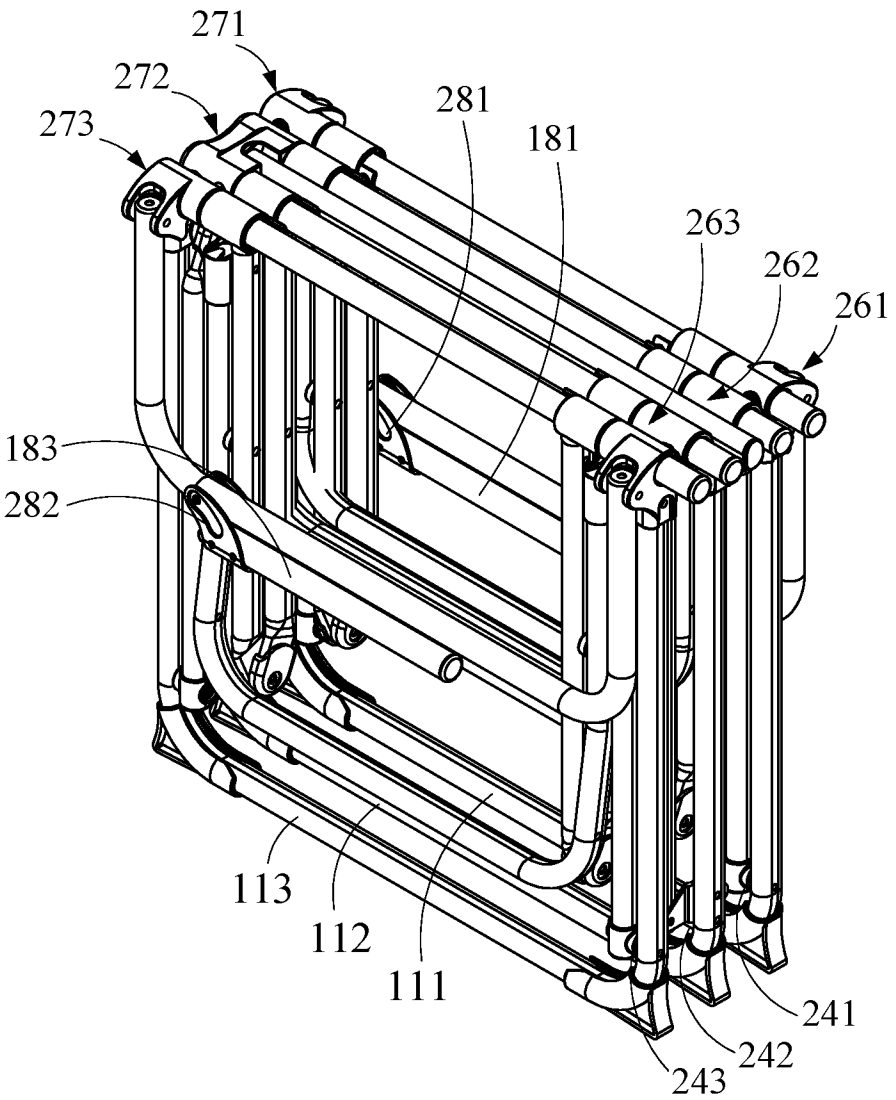
FIG. 6 is a perspective view showing the folding chair of FIG. 2 without the seat and the backrest is fully collapsed into a slim-folded state.

Thereafter, as shown in FIG. 5, pivotally turn the first backrest support 181 about the first backrest support pivot 281 to move the first backrest support 181 toward the first armrest 121; and pivotally turn the second backrest support 182 about the second rear pivot 272 to move the second backrest support 182 toward the second seat receiver 132 and the third seat receiver 133; and pivotally turn the third backrest support 183 about the second backrest support pivot 282 to move the third backrest support 183 toward the second armrest 122. Then, pivotally turn the first armrest 121 about the first front pivot 261 and the first rear pivot 271 to move the first armrest 121 toward the first leg 111, and pivotally turn the second armrest 122 about the third front pivot 263 and the third rear pivot 273 to move the second armrest 122 toward the third leg 113. At this point, as shown in FIG. 6, the entire folding chair is fully collapsed into a slim-folded state, in which the collapsed folding chair does not occupy too much space and is easily portable.

Further, to extend the collapsed folding chair according to the present disclosure, simply operate the above-described procedures in the reverse sequence. Finally, the first supporting frame member 101, the second supporting frame member 102, the third supporting frame member 103, the fourth supporting frame member 104, the first leg 111, the second leg 112, the third leg 113, the first armrest 121, the second armrest 122, the first seat receiver 131, the second seat receiver 132, the third seat receiver 133, the fourth seat receiver 134, the first front support 141, the second front support 142, the third front support 143, the fourth front support 144, the first rear support 151, the second rear support 152, the third rear support 153, the fourth rear support 154, the first front connecting member 161, the second front connecting member 162, the third front connecting member 163, the fourth front connecting member 164, the first rear connecting member 171, the second rear connecting member 172, the third rear connecting member 173, the fourth rear connecting member 174, the first backrest support 181, the second backrest support 182 and the third backrest support 183 can be pivotally turned at the first front pivoting limiter 201, the second front pivoting limiter 202, the first rear pivoting limiter 211, the second rear pivoting limiter 212, the first front pivotal connector 221, the second front pivotal connector 222, the first rear pivotal connector 231, the second rear pivotal connector 232, the first front support pivot 241, the second front support pivot 242, the third front support pivot 243, the first rear support pivot 251, the second rear support pivot 252, the third rear support pivot 253, the first front pivot 261, the second front pivot 262, the third front pivot 263, the first rear pivot 271, the second rear pivot 272, the third rear pivot 273, the first backrest support pivot 281 and the second backrest support pivot 282 to provide a fully extended folding chair with good stability and load capacity in use, as shown in FIG. 2.

In the embodiment illustrated in FIG. 2, the first supporting frame member 101, the second supporting frame member 102, the third supporting frame member 103, the fourth supporting frame member 104, the first leg 111, the second leg 112 and the third leg 113 are U-shaped members, and the first armrest 121 and the second armrest 122 are inverted U-shaped members. With this design, they can be simultaneously pivotally turned at the first front pivoting limiter 201, the second front pivoting limiter 202, the first rear pivoting limiter 211, the second rear pivoting limiter 212, the first front pivot 261, the second front pivot 262, the third front pivot 263, the first rear pivot 271 and the second rear pivot 272 and moved smoothly like in a linkage gearing when collapsing or extending the folding chair. And, the folding chair in the fully extended state provides good stability and load capacity in use.

In the embodiment illustrated in FIG. 2, the first front pivoting limiter 201 includes a first coupler 2011, a second coupler 2012, a third coupler 2013 and a fourth coupler 2014, which are mutually pivotally connected to one another. The first coupler 2011 is connected to one end of the first supporting frame member 101, the second coupler 2012 is connected to the upper end of the first front support 141, the third coupler 2013 is connected to one end of the second supporting frame member 102, and the fourth coupler 2014 is connected to the upper end of the second front support 142. With these arrangements, the first supporting frame member 101, the first front support 141, the second supporting frame member 102 and the second front support 142 can be smoothly pivotally turned about the first front pivoting limiter 201 simultaneously when collapsing or extending the folding chair. And, the fully extended folding chair provides improved stability and load capacity in use.

In the embodiment illustrated in FIG. 2, the second front pivoting limiter 202 includes a fifth coupler 2021, a sixth coupler 2022, a seventh coupler 2023 and an eighth coupler 2024, which are mutually pivotally connected to one another. The fifth coupler 2021 is connected to one end of the third supporting frame member 103, the sixth coupler 2022 is connected to the upper end of the third front support 143, the seventh coupler 2023 is connected to one end of the fourth supporting frame member 104, and the eighth coupler 2024 is connected to the upper end of the fourth front support 144. With these arrangements, the third supporting frame member 103, the third front support 143, the fourth supporting frame member 104 and the fourth front support 144 can be smoothly pivotally turned about the second front pivoting limiter 202 simultaneously when collapsing or extending the folding chair. And, the fully extended folding chair provides improved stability and load capacity in use.

In the embodiment illustrated in FIG. 2, the first rear pivoting limiter 211 includes a ninth coupler 2111, a tenth coupler 2112, an eleventh coupler 2113 and a twelfth coupler 2114, which are mutually pivotally connected to one another. The ninth coupler 2111 is connected to the other end of the first supporting frame member 101, the tenth coupler 2112 is connected to the upper end of the first rear support 151, the eleventh coupler 2113 is connected to the other end of the second supporting frame member 102, and the twelfth coupler 2114 is connected to the upper end of the second rear support 152. With these arrangements, the first supporting frame member 101, the first rear support 151, the second supporting frame member 102 and the second rear support 152 can be smoothly pivotally turned about the first rear pivoting limiter 211 simultaneously when collapsing or extending the folding chair. And, the fully extended folding chair provides improved stability and load capacity in use.

In the embodiment illustrated in FIG. 2, the second rear pivoting limiter 212 includes a thirteenth coupler 2121, a fourteenth coupler 2122, a fifteenth coupler 2123 and a sixteenth coupler 2124, which are mutually pivotally connected to one another. The thirteenth coupler 2121 is connected to the other end of the third supporting frame member 103, the fourteenth coupler 2122 is connected to the upper end of the third rear support 153, the fifteenth coupler 2123 is connected to the other end of the fourth supporting frame member 104, and the sixteenth coupler 2124 is connected to the upper end of the fourth rear support 154. With these arrangements, the third supporting frame member 103, the third rear support 153, the fourth supporting frame member 104 and the fourth rear support 154 can be smoothly pivotally turned about the second rear pivoting limiter 212 simultaneously when collapsing or extending the folding chair. And, the fully extended folding chair provides improved stability and load capacity in use.

In the embodiment illustrated in FIG. 2, the first front pivot 261 includes a first union 2611, a second union 2612, a third union 2613 and a fourth union 2614. The first union 2611 is connected to an upper front end of the first leg 111, the second union 2612 is pivotally connected to a lower front end of the first armrest 121, the third union 2613 is connected near to a front end of the first seat receiver 131, and the fourth union 2614 is pivotally mounted on the first seat receiver 131 and connected to the upper end of the first front connecting member 161. With these arrangements, the first leg 111, the first armrest 121, the first seat receiver 131 and the first front connecting member 161 can be smoothly pivotally turned about the first front pivot 261 simultaneously when collapsing or extending the folding chair. And, the fully extended folding chair provides improved stability and load capacity in use.

In the embodiment illustrated in FIG. 2, the second front pivot 262 includes a fifth union 2621, a sixth union 2622, a seventh union 2623, an eighth union 2624 and a ninth union 2625. The fifth union 2621 is connected to an upper front end of the second leg 112, the sixth union 2622 is connected near to a front end of the second seat receiver 132, the seventh union 2623 is connected near to a front end of the third seat receiver 133, the eighth union 2624 is pivotally mounted on the second seat receiver 132 and connected to the upper end of the second front connecting member 162, and the ninth union 2625 is pivotally mounted on the third seat receiver 133 and connected to the upper end of the third front connecting member 163. With these arrangements, the second leg 112, the second seat receiver 132, the third seat receiver 133, the second front connecting member 162 and the third front connecting member 163 can be smoothly pivotally turned about the second front pivot 262 simultaneously when collapsing or extending the folding chair. And, the fully extended folding chair provides improved stability and load capacity in use.

In the embodiment illustrated in FIG. 2, the third front pivot 263 includes a tenth union 2631, an eleventh union 2632, a twelfth union 2633 and a thirteenth union 2634. The tenth union 2631 is connected to an upper front end of the third leg 113, the eleventh union 2632 is pivotally connected to a lower front end of the second armrest 122, the twelfth union 2633 is connected near to a front end of the fourth seat receiver 134, and the thirteenth union 2634 is pivotally mounted on the fourth seat receiver 134 and connected to the upper end of the fourth front connecting member 164. With these arrangements, the third leg 113, the second armrest 122, the fourth seat receiver 134 and the fourth front connecting member 164 can be smoothly pivotally turned about the third front pivot 263 simultaneously when collapsing or extending the folding chair. And, the fully extended folding chair provides improved stability and load capacity in use.

In the embodiment illustrated in FIG. 2, the first rear pivot 271 includes a fourteenth union 2711, a fifteenth union 2712, a sixteenth union 2713 and a seventeenth union 2714. The fourteenth union 2711 is connected to an upper rear end of the first leg 111, the fifteenth union 2712 is pivotally connected to a lower rear end of the first armrest 121, the sixteenth union 2713 is connected near to a rear end of the first seat receiver 131, and the seventeenth union 2714 is pivotally mounted on the first seat receiver 131 and connected to the upper end of the first rear connecting member 171. With these arrangements, the first leg 111, the first armrest 121, the first seat receiver 131 and the first rear connecting member 171 can be smoothly pivotally turned about the first rear pivot 271 simultaneously when collapsing or extending the folding chair. And, the fully extended folding chair provides improved stability and load capacity in use.

In the embodiment illustrated in FIG. 2, the second rear pivot 272 includes an eighteenth union 2721, a nineteenth union 2722, a twentieth union 2723, a twenty-first union 2724 and a twenty-second union 2725. The eighteenth union 2721 is connected to an upper rear end of the second leg 112, the nineteenth union 2722 is connected near to a rear end of the second seat receiver 132, the twentieth union 2723 is connected near to a rear end of the third seat receiver 133, the twenty-first union 2724 is pivotally mounted on the second seat receiver 132 and connected to the upper end of the second rear connecting member 172, and the twenty-second union 2725 is pivotally mounted on the third seat receiver 133 and connected to the upper end of the third rear connecting member 173. Further, the second backrest support 182 is pivotally connected to between the nineteenth union 2722 and the twentieth union 2723. With these arrangements, the second leg 112, the second seat receiver 132, the third seat receiver 133, the second rear connecting member 172, the third rear connecting member 173 and the second backrest support 182 can be smoothly pivotally turned about the second rear pivot 272 simultaneously when collapsing or extending the folding chair. And, the fully extended folding chair provides improved stability and load capacity in use.

In the embodiment illustrated in FIG. 2, the third rear pivot 273 includes a twenty-third union 2731, a twenty-fourth union 2732, a twenty-fifth union 2733 and a twenty-sixth union 2734. The twenty-third union 2731 is connected to an upper rear end of the third leg 113, the twenty-fourth union 2732 is pivotally connected to a lower rear end of the second armrest 122, the twenty-fifth union 2733 is connected near to a rear end of the fourth seat receiver 134, and the twenty-sixth union 2734 is pivotally mounted on the fourth seat receiver 134 and connected to the upper end of the fourth rear connecting member 174. With these arrangements, the third leg 113, the second armrest 122, the fourth seat receiver 134 and the fourth rear connecting member 174 can be smoothly pivotally turned about the third rear pivot 273 simultaneously when collapsing or extending the folding chair. And, the fully extended folding chair provides improved stability and load capacity in use.

While the present disclosure has been described by means of a specific embodiment, numerous modifications and variations could be made thereto by those skilled in the art without departing from the scope and spirit of the present disclosure set forth in the claims.

What is claimed is:

1. A folding chair, comprising:

a first supporting frame member, a second supporting frame member, a third supporting frame member, a fourth supporting frame member, a first leg, a second leg, a third leg, a first armrest, a second armrest, a first seat receiver, a second seat receiver, a third seat receiver, a fourth seat receiver, a first front support, a second front support, a third front support, a fourth front support, a first rear support, a second rear support, a third rear support, a fourth rear support, a first front connecting member, a second front connecting member, a third front connecting member, a fourth front connecting member, a first rear connecting member, a second rear connecting member, a third rear connecting member, a fourth rear connecting member, a first backrest support, a second backrest support, a third backrest support, a first front pivoting limiter, a second front pivoting limiter, a first rear pivoting limiter, a second rear pivoting limiter, a first front pivotal connector, a second front pivotal connector, a first rear pivotal connector, a second rear pivotal connector, a first front support pivot, a second front support pivot, a third front support pivot, a first rear support pivot, a second rear support pivot, a third rear support pivot, a first front pivot, a second front pivot, a third front pivot, a first rear pivot, a second rear pivot, a third rear pivot, a first backrest support pivot, a second backrest support pivot, a seat, and a backrest;

the first supporting frame member having two ends separately connected to the first front pivoting limiter and the first rear pivoting limiter; the second supporting frame member being located opposite to the first supporting frame member and having two ends also separately connected to the first front pivoting limiter and the first rear pivoting limiter; the third supporting frame member having two ends separately connected to the second front pivoting limiter and the second rear pivoting limiter; and the fourth supporting frame member being located opposite to the third supporting frame member and having two ends also separately connected to the second front pivoting limiter and the second rear pivoting limiter;

the first leg having two upper ends separately connected to the first front pivot and the first rear pivot; the second leg having two upper ends separately connected to the second front pivot and the second rear pivot; and the third leg having two upper ends separately connected to the third front pivot and the third rear pivot;

the first armrest having two lower ends separately connected to the first front pivot and the first rear pivot; and the second armrest having two lower ends separately connected to the third front pivot and the third rear pivot;

the first seat receiver having two ends separately connected to the first front pivot and the first rear pivot; the second seat receiver having two ends separately connected to the second front pivot and the second rear pivot; the third seat receiver having two ends also separately connected to the second front pivot and the second rear pivot; and the fourth seat receiver having two ends separately connected to the third front pivot and the third rear pivot;

the first front support having an upper end connected to the first front pivoting limiter and another lower end connected to the first front support pivot, which is mounted on the first leg near a lower front corner thereof; the second front support having an upper end connected to the first front pivoting limiter and another lower end connected to the second front support pivot, which is mounted on the second leg near a lower front corner thereof; the third front support having an upper end connected to the second front pivoting limiter and another lower end also connected to the second front support pivot; and the fourth front support having an upper end connected to the second front pivoting limiter and another lower end connected to the third front support pivot, which is mounted on the third leg near a lower front corner thereof;

the first rear support having an upper end connected to the first rear pivoting limiter, and another lower end connected to the first rear support pivot, which is mounted on the first leg near a lower rear corner thereof; the second rear support having an upper end also connected to the first rear pivoting limiter, and another lower end connected to the second rear support pivot, which is mounted on the second leg near a lower rear corner thereof; the third rear support having an upper end connected to the second rear pivoting limiter, and another lower end also connected to the second rear support pivot; and the fourth rear support having an upper end also connected to the second rear pivoting limiter, and another lower end connected to the third rear support pivot, which is mounted on the third leg near a lower rear corner thereof;

the first front connecting member having a lower and an upper end connected to the first front pivotal connector and the first front pivot, respectively; the second front connecting member having a lower and an upper end connected to the first front pivotal connector and the second front pivot, respectively; the third front connecting member having a lower and an upper end connected to the second front pivotal connector and the second front pivot, respectively; and the fourth front connecting member having a lower and an upper end connected to the second front pivotal connector and the third front pivot, respectively;

the first rear connecting member having a lower and an upper end connected to the first rear pivotal connector and the first rear pivot, respectively; the second rear connecting member having a lower and an upper end connected to the first rear pivotal connector and the second rear pivot, respectively; the third rear connecting member having a lower and an upper end connected to the second rear pivotal connector and the second rear pivot, respectively; and the fourth rear connecting member having a lower and an upper end connected to the second rear pivotal connector and the third rear pivot, respectively;

the first backrest support having a lower end connected to the first backrest support pivot, which is mounted on the first armrest near an upper rear corner thereof; the second backrest support having a lower end connected to the second rear pivot; and the third backrest support having a lower end connected to the second backrest support pivot, which is mounted on the second armrest near an upper rear corner thereof;

the first front connecting member and the first rear connecting member being assembled to the first supporting frame member; the second front connecting member and the second rear connecting member being assembled to the second supporting frame member; the third front connecting member and the third rear connecting member being assembled to the third supporting frame member; and the fourth front connecting member and the fourth rear connecting member being assembled to the fourth supporting frame member; and the seat being supported on and connected to the first seat receiver, the second seat receiver, the third seat receiver and the fourth seat receiver; and the backrest being supported on and connected to the first backrest support, the second backrest support and the third backrest support; and the backrest and the seat being connected to each other.

2. The folding chair according to claim 1, wherein the first supporting frame member, the second supporting frame member, the third supporting frame member, the fourth supporting frame member, the first leg, the second leg and the third leg are respectively a U-shaped member; and the first armrest and the second armrest are respectively an inverted U-shaped member.

3. The folding chair according to claim 1, wherein the first front pivoting limiter includes a first coupler, a second coupler, a third coupler and a fourth coupler, which are mutually pivotally connected to one another; and, the first coupler being connected to one end of the first supporting frame member, the second coupler being connected to the upper end of the first front support, the third coupler being connected to one end of the second supporting frame member, and the fourth coupler being connected to the upper end of the second front support.

4. The folding chair according to claim 1, wherein the second front pivoting limiter includes a fifth coupler, a sixth coupler, a seventh coupler and an eighth coupler, which are mutually pivotally connected to one another; and, the fifth coupler being connected to one end of the third supporting frame member, the sixth coupler being connected to the upper end of the third front support, the seventh coupler being connected to one end of the fourth supporting frame member, and the eighth coupler being connected to the upper end of the fourth front support.

5. The folding chair according to claim 1, wherein the first rear pivoting limiter includes a ninth coupler, a tenth coupler, an eleventh coupler and a twelfth coupler, which are mutually pivotally connected to one another; and, the ninth coupler being connected to the other end of the first supporting frame member, the tenth coupler being connected to the upper end of the first rear support, the eleventh coupler being connected to the other end of the second supporting frame member, and the twelfth coupler being connected to the upper end of the second rear support.

6. The folding chair according to claim 1, wherein the second rear pivoting limiter includes a thirteenth coupler, a fourteenth coupler, a fifteenth coupler and a sixteenth coupler, which are mutually pivotally connected to one another; and, the thirteenth coupler being connected to the other end of the third supporting frame member, the fourteenth coupler being connected to the upper end of the third rear support, the fifteenth coupler being connected to the other end of the fourth supporting frame member, and the sixteenth coupler being connected to the upper end of the fourth rear support.

7. The folding chair according to claim 1, wherein the first front pivot includes a first union, a second union, a third union and a fourth union; and, the first union being connected to an upper front end of the first leg, the second union being pivotally connected to a lower front end of the first armrest, the third union being connected near to a front end of the first seat receiver, and the fourth union being pivotally mounted on the first seat receiver and connected to the upper end of the first front connecting member.

8. The folding chair according to claim 1, wherein the second front pivot includes a fifth union, a sixth union, a seventh union, an eighth union and a ninth union; and, the fifth union being connected to an upper front end of the second leg, the sixth union being connected near to a front end of the second seat receiver, the seventh union being connected near to a front end of the third seat receiver, the eighth union being pivotally mounted on the second seat receiver and connected to the upper end of the second front connecting member, and the ninth union being pivotally mounted on the third seat receiver and connected to the upper end of the third front connecting member.

9. The folding chair according to claim 1, wherein the third front pivot includes a tenth union, an eleventh union, a twelfth union and a thirteenth union; and, the tenth union being connected to an upper front end of the third leg, the eleventh union being pivotally connected to a lower front end of the second armrest, the twelfth union being connected near to a front end of the fourth seat receiver, and the thirteenth union being pivotally mounted on the fourth seat receiver and connected to the upper end of the fourth front connecting member.

10. The folding chair according to claim 1, wherein the first rear pivot includes a fourteenth union, a fifteenth union, a sixteenth union and a seventeenth union; and, the fourteenth union being connected to an upper rear end of the first leg, the fifteenth union being pivotally connected to a lower rear end of the first armrest, the sixteenth union being connected near to a rear end of the first seat receiver, and the seventeenth union being pivotally mounted on the first seat receiver and connected to the upper end of the first rear connecting member.

11. The folding chair according to claim 1, wherein the second rear pivot includes an eighteenth union, a nineteenth union, a twentieth union, a twenty-first union and a twenty-second union; and, the eighteenth union being connected to an upper rear end of the second leg, the nineteenth union being connected near to a rear end of the second seat receiver, the twentieth union being connected near to a rear end of the third seat receiver, the twenty-first union being pivotally mounted on the second seat receiver and connected to the upper end of the second rear connecting member, and the twenty-second union being pivotally mounted on the third seat receiver and connected to the upper end of the third rear connecting member; and, the second backrest support being pivotally connected to between the nineteenth union and the twentieth union.

12. The folding chair according to claim 1, wherein the third rear pivot includes a twenty-third union, a twenty-fourth union, a twenty-fifth union and a twenty-sixth union; and, the twenty-third union being connected to an upper rear end of the third leg, the twenty-fourth union being pivotally connected to a lower rear end of the second armrest, the twenty-fifth union being connected near to a rear end of the fourth seat receiver, and the twenty-sixth union being pivotally mounted on the fourth seat receiver and connected to the upper end of the fourth rear connecting member.

* * * * *